US005092944A

United States Patent [19]

Stott et al.

[11] Patent Number: 5,092,944

[45] Date of Patent: Mar. 3, 1992

[54] HIGH ENERGY CAST EXPLOSIVES BASED ON DINITROPROPYLACRYLATE

[75] Inventors: Barbara A. Stott, Ridgecrest, Calif.; Lily E. Koch, Henderson, Nev.

[73] Assignee: The United States of America as represented by the Secretary of the Navy, Washington, D.C.

[21] Appl. No.: 682,937

[22] Filed: May 7, 1976

[51] Int. Cl.[5] ..... C06B 45/10

[52] U.S. Cl. ..... 149/19.3; 149/19.91; 149/92; 149/111

[58] Field of Search ..... 149/19.3, 19.91, 92, 149/111; 264/3 D, 3 E

[56] References Cited

U.S. PATENT DOCUMENTS

| | | | |
|---|---|---|---|
| 3,138,501 | 6/1964 | Wright | 149/92 |
| 3,296,041 | 1/1967 | Wright | 149/92 X |
| 3,389,026 | 6/1968 | Johnson | 149/19 |
| 3,480,490 | 11/1969 | Finger et al. | 149/92 |
| 3,723,204 | 3/1973 | Evans | 149/19 |
| 3,804,683 | 4/1974 | Baldwin et al. | 149/92 X |
| 3,830,674 | 8/1974 | Randolph et al. | 149/19.91 X |
| 3,957,549 | 5/1976 | Baldwin | 149/19.91 X |
| 3,972,967 | 8/1976 | Sayles | 149/19.91 X |
| 3,976,522 | 8/1976 | Rothenstein | 149/92 |
| 4,029,529 | 6/1977 | Elrick et al. | 149/19.91 X |

FOREIGN PATENT DOCUMENTS

| | | | |
|---|---|---|---|
| 849967 | 9/1960 | United Kingdom | 149/111 |

*Primary Examiner*—Peter A. Nelson

*Attorney, Agent, or Firm*—Melvin J. Sliwka; John L. Forrest, Jr.

[57] ABSTRACT

A castable explosive composition of 80 to 87 percent cyclo-1,3,5,7-tetramethylene-2,4,6,8-tetra nitramine (HMX) in dinitropropyl acrylate binder is obtained through careful choice of particle sizes. Up to 92% solids loading, without loss of castability, is obtained when spherical aluminum is incorporated into the mix. Other comonomers may be used in the binder and other solids added.

20 Claims, No Drawings

HIGH ENERGY CAST EXPLOSIVES BASED ON DINITROPROPYLACRYLATE

BACKGROUND OF THE INVENTION

This invention relates to plastic-bonded cast explosives.

Most plastic-bonded explosives are based on inert binders such as polyesters, polyurethanes or polyacrylates.

The binder is typically present in from 10 to 40 weight percent of the composition, the remainder being filled with explosives such as pentaerythritol tetranitrate (PETN), trinitrophenylmethylnitramine (tetryl), cyclotrimethylenetrinitramine (RDX), cyclo-1,3,5,7-tetramethylene-2,4,6,8-tetranitramine, (HMX) etc. A great variety of other solid additives, such as oxidizers and exothermic metals have been previously employed in plastic-bonded explosives. Of course, in order to maximize explosive energy, a high degree of solids loading is desired. Solids loading is the term generally solids described above.

Typically, solids are added to the liquid binder while in monomeric form. The binder is then polymerized to form the solid explosive composition.

For various applications, such as shaped charges, the explosive must be machined into the desired shape. Obviously, processing is greatly expedited if the composition can be cast into a mold and then cured to the desired shape. However, casting requires good rheological properties and a viscosity lower than that of most binders which are highly loaded with solids.

One solution to the problem of providing a high energy yet castable explosive is to use a binder which is itself an explosive. Finger et al. in U.S. Pat. No. 3,480,490 disclose that the liquid explosive 2,2-dinitropropyl acrylate (hereinafter termed DNPA) may be mixed with HMX, polymerized to form poly DNPA, cast, and cured. Finger et al. recognized the effect of the particle size of the HMX on the fluid properties of the composition, but concluded that 20p HMX was the optimum size and that HMX content could not be increased beyond 75%.

SUMMARY OF THE INVENTION

A composition containing 80 to 87% of a solid explosive, cyclo-1,3,5,7-tetramethylene-2,4,6,8-tetranitramine, (HMX) in liquid dinitro-propylacrylate (DNPA), is castable if the proper granulations of HMX particles are used. Up to 92% solids loading can be obtained with the inclusion of about 5% aluminum. The composition cures to a firm elastomer with a very high explosive potential. The HMX is desensitized prior to mixing with a volatile liquid or by coating with a portion of the binder. The binder maybe modified with crosslinking agents or comonomers to improve physical properties without sacrificing solids loading or castability. Cobaltous acetyl acetonate is an effective polymerizing activator when used with a peroxide catalyst. Other solids, such as ammonium perchlorate or aluminum may replace some of the HMX without loss of castable properties.

DESCRIPTION OF THE PREFERRED EMBODIMENT

The Binder

DNPA monomer is a thin, nearly colorless liquid of low volatility and viscosity. It may be synthesized from nitroethane by the Shechter-Kaplan procedure but it is best obtained commercially and is available from a number of suppliers. It is polymerized by saturation of the acrylate double bond, a reaction the inventors have found to be particularly activated by cobaltous acetylacetonate. Other free radical chain initiators may also be used.

In order to improve the thermal and dimensional stability of the poly DNP binder, various crosslinking agents may be employed. Inclusion of 2–5% triallyl cyanurate, tetramethylene diacrylate, 2,2-dinitropropyl-1,3-diacrylate, or acetyl triallyl citrate in the binder will improve thermal stability. 3% (based on binder) acetyl triallyl citrate in a 75:25 HMX/binder mix showed only 1% change at 150° C.

Improved explosive potential and physical properties of the DNPA binder may be obtained by the substitution of other energetic acrylate comonomers in the binder. Upon polymerization, a comonomer will link up with the DNPA to form various links in the polymer chain, called then a copolymer. Examples of suitable comonomers are bis (dinitropropyl) maleate; 2,3-bis(difluoroamino propyl) acrylate (NFPA), and other fluorinated alkylacrylates; or fluorodinitrile alkylacrylates. Binders with DNPA/NFPA ratios of 1:1,1:3,3:1, and 0:1 all have good physical properties. NFPA, $CH_2(NF_2)CH(NF_2)CH_2OCOCH{=}CH_2$, has highly energetic properties. It readily forms a copolymer with DNPA because of its similarity to the basic propyl acrylate structure, $CH_3CH_2CH_2OCOCH{=}CH_2$. Monomers with other alkyl acrylate structures may be substituted with high energy nitrofluoro or fluoro groups and will form suitable copolymers with DNPA. As with NFPA, no special proportions or procedures are necessary.

High Solids Loading

Once the binder system is chosen, its monomeric viscosity is determined and the granulation size of the solids to be added is tailored to the viscosity. Conversely, the viscosity of the binder may be tailored to the desired solids granulation. Binder viscosity may be conveniently increased by the addition of DNPA polymer.

HMX is generally available according to Military Specification, MIL-H-5444A (Ord) 24 April 1961, as amended 20 October 1961, in the following classes: Class A (100–150 microns); Class B (20–30 microns); Class C (300 microns); Class D (600 to 800 microns); and Class E (10–20 microns). Appropriate particle sizes may also b.e obtained by screening through sieves as indicated in the Military Specification. 200μ HMX is not a standard production grade and must be so obtained. All values given herein represent median particle diameters, as some particle size variation is inevitable with commonly used screening techniques.

The effect of HMX particle size distribution and binder viscosity on processability is given in the table below:

Performance of Some HMX Blends at High Solids Loading with Binders of Varying Viscosity

| Binder viscosity | HMX size distribution 20μ | A | 200μ | D | Maximum % solids loading | Rating at maximum and near maximum loading |
|---|---|---|---|---|---|---|
| Low (approx. 7 centistokes) | 33 | 0 | 0 | 67 | 86–87 | Excellent loadability but grainy |
| | 40 | 0 | 0 | 60 | 86–87 | Soft and extrudable, drier but less grainy |
| | 45 | 0 | 0 | 55 | 85 | Smooth and soft, less fluid at high loadings |
| | 50 | 0 | 0 | 50 | 85 | Soft and extrudable, requires higher binder level |
| | 25 | 0 | 75 | 0 | 83–85 | Poor at all levels, sandy, nonhomogeneous |
| | 0 | 33 | 0 | 67 | 84–85 | Poor at all levels, sandy, nonhomogeneous |
| | 25 | 10 | 0 | 65 | 87 | Somewhat grainy but very wet |
| | 35 | 10 | 0 | 55 | 87–88 | Softer, smoother, excellent texture and loadability |
| | 35 | 0 | 10 | 55 | 86–87 | Slightly inferior to 35/10/0/55 |
| | 25 | 25 | 0 | 50 | 85 | Sandy and nonhomogeneous |
| | 25 | 0 | 25 | 50 | 85 | Inferior loadability and homogeneity |
| | 33 | 0 | 33 | 33 | 84–85 | Good texture, limited loadability |
| | 33 | 16 | 17 | 33 | 84–85 | Compactible but poor flow and homogeneity |
| High (25–26 centistokes) | 25 | 0 | 0 | 75 | 86 | Harsh and grainy but fairly wet |
| | 33 | 0 | 0 | 67 | 86 | Less grainy, less fluid, cakey |
| | 25 | 10 | 0 | 65 | 86 | Wet,slightly grainy, good properties |
| | 28 | 14 | 0 | 58 | 86 | Good texture, wet, slightly grainy |
| | 35 | 10 | 0 | 55 | 85–86 | Tackier, less grainy, but lower loadability |
| | 15 | 15 | 0 | 70 | <85 | Fluffy, noncompactible, very poor |
| | 33 | 0 | 33 | 33 | 85 | Tacky, soft and puttylike |
| | 33 | 33 | 33 | 0 | 84 | Overly dry. Limited loadability |
| | 25 | 25 | 25 | 25 | 84–85 | Poor flow, tacky, low loadability |
| Medium (approx. 17 centistokes) | 35 | 0 | 0 | 65 | 86–87 | Stiff and doughy but compacts well with vibration |
| | 25 | 10 | 0 | 65 | 87 | Drier than same distribution with low viscostly binder, also less grainy |
| | 28 | 10 | 0 | 62 | 86–87 | Somewhat dry at max. loading. Excellent at 86.5% |
| | 30 | 10 | 0 | 60 | 86 | Wet and soft. Cakey at high loadings |
| | 30 | 0 | 10 | 60 | 86 | Similar to 30/10/0/60 |
| | 35 | 10 | 0 | 55 | 86 | Tacky, more limited loadability |
| | 33 | 33 | 0 | 33 | 84–85 | Excellent texture, limited loadability |

The data of the table was obtained from simulant binders with density and wettability close to that of DPNA. Tests with actual binders have borne out this data.

As can be seen HMX was added in 2,3, or sometimes 4 different particle sizes, and solids loading of 85 to 87% was obtained.

In essence, at high percentages of solids, the binder acts as a lubricant between the particles. When the binder has low viscosity, it drains away from the solids, allowing the larger particles to grate on one another. The finer sized particles, around 20μ, of HMX or ammonium perchlorate will adsorb binder onto their surfaces and prevent its draining away. The fine aluminum particles act as tiny ball bearings between the large particles.

Ammonium, sodium, potassium, and barium perchlorate in amounts from 19 to 26% of the total mix were incorporated into the composition without loss of optimum solids loading and processability. The particle size distribution of the perchlorate added should match that of the HMX it replaces. Ammonium perchlorate with median particle size of 600–700μ has been successfully incorporated into DPNA binders. This of course replaced large HMX particles. 20μ particles have also been used. Perchlorates improve the oxygen balance of the mixture. Ammonium and potassium perchlorate are preferred. Metal powders such as aluminum may similarly be added to modify detonation characteristics. The metal granules should be spherical grade to provide small-"ball bearing"-component in the size distribution. Solids loading up to 92% has been obtained with the incorporation of approximately 20% 5μ aluminum.

Procedures

The HMX or other solid explosive is first desensitized. Those skilled in the art will recognize that HMX is an explosive of the cyclic nitramine class and other explosives in the class such as RDX, are, for the purposes of the present invention, equivalent to HMX. Explosive compositions with RDX have been prepared using RDX in sizes equivalent to HMX Classes A,C,D and E. RDX is easier to process because its particles are more rounded. HMX has been effectively desensitized by wetting with a volatile nonsolvent such as dichloromethane, Freon, or petroleum ether.

If a crosslinking agent or comonomer is to be used in the binder it should premixed in the binder. Just prior to blending the solids into the binder, a polymerization activator is added to the binder. A common initiator used in vinyl polymerization may be used, although some experimentation may be necessary to overcome the inhibitors supplied in commercial DNPA. Colbaltous acetyl acetonate (CoAA) and dimethyl aniline have been found especially effective. Activator concentrations may be from 0.05 to 0.3% of the binder, although 0.1% CoAA is preferred.

The solids and binder, having been chosen, weighed and prepared according to the foregoing discussion, are then thoroughly blended using standard mixing techniques as in a Baker-Perkins mixer. The volatile desensitizing liquid is then removed during continued mixing under slightly elevated temperatures (up to 50° C.) and vacuum.

When binder and solids have been adequately mixed and any non-permanent desensitizers have been removed, a peroxide curative is then blended into the mix in an amount approximately equal to 1.0% of the binder. A curative of a 50:50 mixture of τ- butyl perbenzoate and τ- butyl hydroperoxide has been successfully used. The peroxide curative, in conjunction with the previously added CoAA initiates polymerization and if crosslinking agents have been added, crosslinking.

The mixture is then transferred to a mold using standard techniques. Vacuum casting while vibrating the molds produces void free elastomers with 0.1% CoAA and 1% τBPB/τBHP, overnight cures at room temperature to 60° C. have been obtained. For optimum cures, the composition should be degassed and air excluded during cure.

An explosive molding powder may be produced by coating the poly DNPA onto HMX in a slurry. A low molecular weight prepolymer of DNPA may also be used as a precoat to desensitize HMX for the process given above. Of course many variations on the procedures detailed herein are possible.

What is claimed is:

1. A castable composition comprising 80 to 90 weight percent solids and 10 to 20 weight percent liquid binder wherein at least 60% of said solids are HMX particles having a size distribution of from 25 to 50% 20 μ particles; and from 75 to 50% 600 to 800 μ particles.

2. A castable composition comprising 80 to 90 weight percent solids and 10 to 20 weight percent liquid binder wherein at least 60% of said solids are HMX particles having a size distribution of from 25 to 35% 20 μ particles;

from 10 to 33% 100 to 150 μ particles; and from 33 to 65% 600 to 800 μ particles.

3. A castable composition comprising 80 to 90 weight percent solids and 10 to 20 weight percent liquid binder wherein at least 60% of said solids are HMX particles having a size distribution of from 25 to 35% 20 μ particles;

10 to 33% 200 μ particles; and 33 to 60% 600 to 800 μ particles.

4. A castable composition comprising 80 to 90 weight percent solids and 10 to 20 weight percent liquid binder wherein at least 60% of said solids are HMX particles having a size distribution of 33% 20 μ particles;

16% 100 to 150 μ particles;

17% 200 μ particles; and

33% 600 to 800 μ particles.

5. A castable composition according to claim 1 wherein said liquid binder comprises DNPA.

6. A castable composition according to claim 1 wherein said liquid binder comprises a mixture of DNPA and bis(dinitropropyl)maleate.

7. A castable composition according to claim 1 wherein said liquid binder comprises a mixture of DNPA and 2,3-bis(difluoroaminopropyl)acrylate.

8. A castable composition according to claim 1 wherein said liquid binder comprises NFPA.

9. A castable composition according to claim 2 wherein said liquid binder comprises DNPA.

10. A castable composition according to claim 2 wherein said liquid binder comprises a mixture of DNPA and bis(dinitropropyl)maleate.

11. A castable composition according to claim 2 wherein said liquid binder comprises a mixture of DNPA and 2,3-bis(difluoroaminopropyl)acrylate.

12. A castable composition according to claim 2 wherein said liquid binder comprises NFPA.

13. A castable composition according to claim 3 wherein said liquid binder comprises DNPA.

14. A castable composition according to claim 3 wherein said liquid binder comprises a mixture of DNPA and bis(dinitropropyl)maleate.

15. A castable composition according to claim 3 wherein said liquid binder comprises a mixture of DNPA and 2,3-bis(difluoroaminopropyl)acrylate.

16. A castable composition according to claim 3 wherein said liquid binder comprised NFPA.

17. A castable composition according to claim 4 wherein said liquid binder comprises DNPA.

18. A castable composition according to claim 4 wherein said liquid binder comprises a mixture of DNPA and bis(dinitropropyl)maleate.

19. A castable composition according to claim 4 wherein said liquid binder comprises a mixture of DNPA and 2,3-bis(difluoroaminopropyl)acrylate.

20. A castable composition according to claim 4 wherein said liquid binder comprises NFPA.

* * * * *